US005083766A

United States Patent [19]

Osawa

[11] Patent Number: 5,083,766

[45] Date of Patent: Jan. 28, 1992

[54] AUTOMATIC SHEET FEEDING DEVICE HAVING A MINIATURIZED STRUCTURE

[75] Inventor: Yukio Osawa, Yamanashi, Japan

[73] Assignee: Nisca Corporation, Yamanashi, Japan

[21] Appl. No.: 554,418

[22] Filed: Jul. 19, 1990

[30] Foreign Application Priority Data

Jul. 19, 1989 [JP] Japan ..... 1-84792[U]
Jul. 19, 1989 [JP] Japan ..... 1-84793[U]

[51] Int. Cl.[5] ..... B65H 3/52

[52] U.S. Cl. ..... 271/121; 271/3.1; 271/126; 271/242; 271/264; 271/272; 271/160; 271/165; 271/167

[58] Field of Search ..... 271/3.1, 121-124, 271/165, 167, 242, 264, 3, 114, 126, 160, 272, 275

[56] References Cited

U.S. PATENT DOCUMENTS 4,394,009 7/1983 Bergman et al. ..... 271/242 X
4,568,074 2/1986 Murayoshi ..... 271/121
4,589,650 5/1986 Miyoshi ..... 271/242
4,934,683 6/1990 Ueda et al. ..... 271/3.1

FOREIGN PATENT DOCUMENTS 197344 9/1986 Japan ..... 271/242
185653 8/1987 Japan ..... 271/242
218342 9/1987 Japan ..... 271/122

*Primary Examiner*—H. Grant Skaggs
*Assistant Examiner*—Boris Milef
*Attorney, Agent, or Firm*—Oblon, Spivak, McClelland, Maier & Neustadt

[57] ABSTRACT

Between a sheet separation arrangement and a sheet skew correction means which are disposed along a non-linear sheet guide passage, there is provided at least one idle roller partly protruding into the passage so that the transferring efficiency of a sheet feeding device can be improved. Additionally by providing a damping member within the sheet guide passage, a sheet can be smoothly transferred along the passage at a high speed without producing harsh noises.

6 Claims, 5 Drawing Sheets

AUTOMATIC SHEET FEEDING DEVICE HAVING A MINIATURIZED STRUCTURE

BACKGROUND OF THE INVENTION

1. Field of the Invention

This invention relates to a device for automatically feeding stacked sheets one by one to a prescribed position in an image processing device such as a copying machine and image scanner, and more particularly to an automatic sheet feeding device capable of smoothly and stably transferring sheets one by one and materializing miniaturization of system without decreasing the sheet transferring efficiency thereof.

2. Description of the Prior Art

In an electrophotographic copying machine, for example, sheet feeding devices for automatically transferring stacked original sheets (manuscript sheets) to be copied one by one to an original reading position have come to be adopted in general. There is a typical sheet feeding device of this sort which, as illustrated in FIG. 1(A), comprises a sheet stacking tray 2 disposed over the original reading position Pr defined on a transparent platen 1, and a non-linear sheet guide passage 3 along which the document original sheet s to be copied is transferred from the tray 2 to the original reading position Pr. The purpose for which the sheet stacking tray 2 is disposed over the original reding position Pr is to lessen a space for the sheet feeding device to occupy; namely, to improve the space factor of the device. However, in such a structure in which the sheet stacking tray 2 is over the original reading position Pr, it is necessary to curve the sheet guide passage 3 extending from the tray 2 to the original reading position Pr. In order to further improve the space factor of the device, the sheet guide passage must be shortened and reduced in its effective curvature. The reduction of the curvature of the sheet guide passage, nevertheless, exerts adverse effects on the efficiency of transferring the sheet.

As illustrated in FIG. 1(B), the conventional sheet feeding device for transferring a stack of sheets Os one by one from the aforesaid tray 2 to the original reading position Pr basically comprises at least one pickup roller 4 for drawing out one document original sheet s from the stacked sheets Os on the tray 2, a sheet separation means 5 consisting of at least one set of sheet separation roller 5*a* and friction pad 5*b*, and a sheet skew correction means 6 for correcting the sheet obliquely advancing along the passage 3, which consists of at least one pair of skew correction rollers 6*a*, 6*b* and a sheet sensor 6*c*. These elements are arranged along the sheet guide passage 3 defined between an outer guide plate 3*a* and an inner guide plate 3*b* between the tray 2 and the original reading position Pr.

In transferring the original sheet s to the original reading position Pr by use of the sheet feeding device as noted above, the pickup roller 4 and sheet separation roller 5*a* are rotated in the sheet feeding direction to thereby draw out and send one original sheet s from the stacked sheets Os into the sheet guide passage 3. When the sheet s advancing along the sheet guide passage 3 reaches the sheet sensor 6*c*, a timer 7 is operated to effect a time delay function so that the sheet separation roller 5*a* stops immediately after the sheet s reaches the paired skew correction rollers 6*a*, 6*b* and thereafter rotating the skew correction rollers 6*a*, 6*b* in the sheet feeding direction to forward the sheet s. Thus, sheet skew correction can be fulfilled through the aforenoted time delay function.

Even if one or more superfluous sheets are drawn out from the stacked sheets Os together with the sheet s to be copied by rotating the pickup roller 4 in the sheet feeding direction, only one sheet (the lowermost sheet in the illustrated example) is permitted to pass into the sheet guide passage 3 by the action of the sheet separation means 5.

Now, the problem suffered by the conventional sheet feeding device as touched upon above is that if the curvature of the curved sheet guide passage is increased in order to make the device compact, it becomes difficult to obtain smooth flow of the sheet along the sheet guide passage and effectively fulfill the sheet skew correction function, In other words, to put the sheet skew correction into practice with certainty, the sheet advancing along the passage 3 must come to the contact point of the paired skew correction rollers 6*a*, 6*b* as straight as possible without being restricted. Hence, it is desired to form a possibly long straight path 8 by flattening the inner guide plate 3*b* behind the skew correction rollers 6*a*, 6*b* relative to the sheet feeding direction. As a result, there is inevitably formed a sharply curved ridgeline 9 at the entrance of the straight path 8.

Still, the sharply curved ridgeline 9 entails a problem such as difficulty in smoothly forwarding the sheet along the passage 3. To be more specific, because the skew correction rollers 6*a*, 6*b* rotate in the sheet feeding direction to draw the sheet s after the sheet separation roller 5*a* serving to advance the sheet s stops, a tension force is exerted into the sheet between the sheet separation means 5 and the skew correction means 6 as specified in FIG. 1(B). Consequently, since the sheet s advancing along the passage 3 comes in pressure contact with the sharply curved ridgeline 9 due to the tension force exerted into the sheet, the contact resistance of the sheet s with respect to the sharply curved ridgeline 9 becomes large with the result that the sheet s is at times prevented from advancing. In addition, the sheet s advancing along the passage chafes against the ridgeline 9 to thereby take scratches and produce unpleasant harsh noises.

Also, collision of the leading end of the sheet s being introduced into the passage 3 with the outer guide plate 3*a* defining the passage 3 may obstruct the advance of the sheet s and makes unpleasant harsh noises. Moreover, when the sheet s which is drawn to advance by the skew correction rollers 6*a*, 6*b* is released from the sheet separation means 5, the rear end of the sheet s having an elastic force springs back to beat against the outer guide plate 3*a*, consequently to produce unpleasant noises.

As will be understood from the foregoing, in order to eliminate the aforementioned various drawbacks suffered by the conventional sheet feeding device, the sheet guide passage extending from the sheet separation means 5 to the skew correction means 6 had to be so far made small in effective curvature, i.e. curved sharply. The conventional sheet feeding device could be reduced in height only to a limited extend; that is to say, the overall size thereof could not be made small.

OBJECT OF THE INVENTION

This invention is made to eliminate the drawbacks suffered by the conventional sheet feeding device as described above and has an object to provide an automatic sheet feeding device coping with the demands for excellent performance and compactness of the device and speed-up of sheet feeding operation in image processing systems such as an electrophotographic copying machine, which can transfer stacked sheets one by one smoothly, gently and reliably without producing harsh noises.

SUMMARY OF THE INVENTION

To attain the object described above according to this invention there is provided an automatic sheet feeding device comprising an outer guide and inner guide plates for defining a sheet guide passage, a sheet skew correction means including at least one pair of skew correction rollers, and at least one idle roller partly protruding into the sheet guide passage so as to form a substantially straight path between the idle roller and the sheet skew correction means. The straight path may be so arranged as to extend along a tangent line to the idle roller which passes through the contact point of the skew correction rollers.

By providing the idle roller in the sheet guide passage, a sheet is smoothly transferred along the sheet guide passage without being contacted with the inner guide plate. Therefore, the sheet can advance along the passage without a scratch and producing harsh noises even if the sheet guide passage is sharply curved or bent. Thus, since the sheet guide passage can be sharply bent, the device is reduced in height and can be effectively miniaturized.

Furthermore, at the ahead of a sheet separation means disposed about the sheet inlet of the sheet guide passage, an elastic damping member may be attached along the outer guide plate of the sheet guide passage so as to suppress particularly the movements of the leading end of the sheet coming into the sheet guide passage and the rear end of the sheet being released from the sheet separation means. This damping member has also functions of decreasing rustling noises produced by the sheet advancing along the sheet guide passage and preventing failure of sending out the sheet from the sheet guide passage.

The features of the present invention which are believed to be novel are set forth with particularity in the appended claims. The present invention, both as to its organization and manner or operation, together with further objects and advantages thereof, may best be understood by reference to the following description, taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The automatic sheet feeding device according to this invention has a fundamental function of automatically sending original sheets (manuscript sheets) stacked on a sheet stacking tray one by one to an original reading position in an electrophotographic copying machine or the like. Though this sheet feeding device is applied to the copying machine as one example, this should not be understood as limitative.

Figure 2:
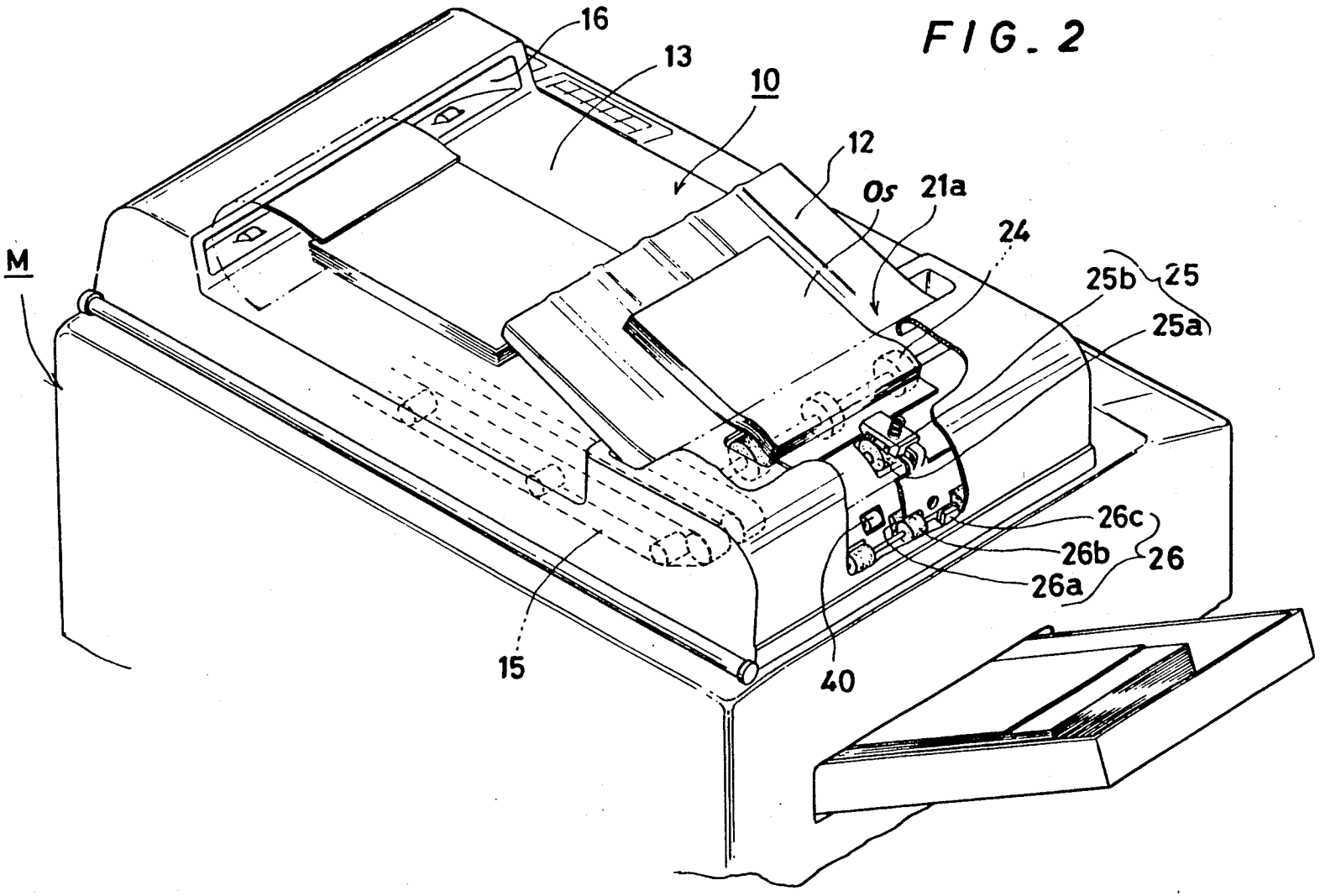
FIG. 2 is a perspective view, partially in section, of a copying machine to which one embodiment of the sheet feeding device according to this invention is applied.
Figure 3:
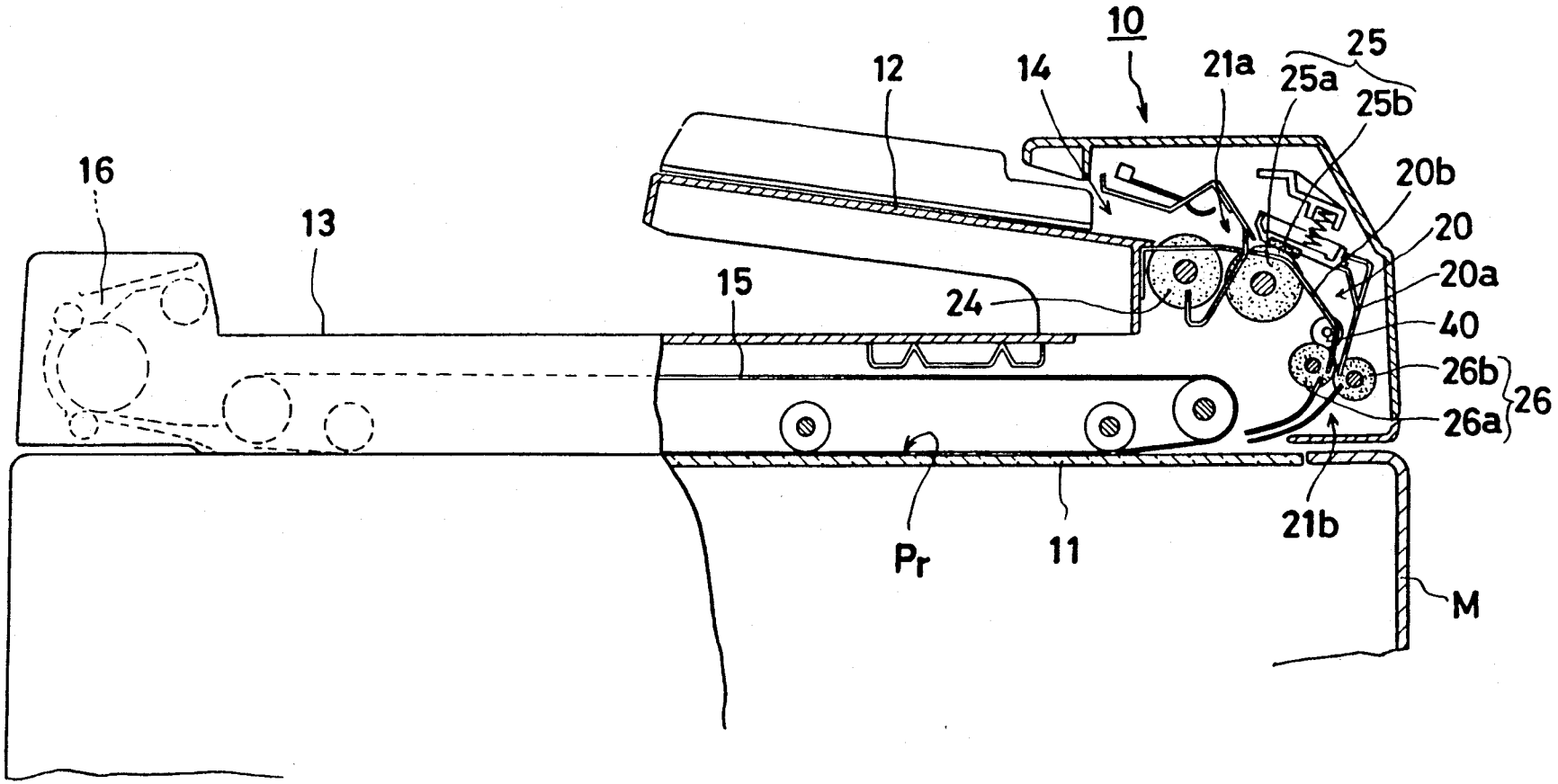
FIG. 3 is a sectional side view showing a part of the copying machine of FIG. 2.

As illustrated in FIG. 2 and FIG. 3, the copying machine M has a transparent platen 11 on which an original reading or copying position Pr is defined. The sheet feeding device 10 according to this invention is pivotally connected at one side thereof to the upper portion of the copying machine M.

The sheet feeding device 20 is provided with a sheet stacking tray 12 on which a stack of original sheets Os to be copied is placed, and an output tray 13 for receiving the original sheets upon completion of copying. These trays 12, 13 are placed over the platen 11. The original sheets stacked on the tray 12 are introduced into a sheet guide passage 20 one by one. The sheet s introduced into the passage 20 is fed to the original reading position Pr on the platen 11 by use of a transferring means 10 such as endless belts. After copied, the original sheet s on the platen 11 is sent out to the output tray 13 through an exhaust passage 16. The basic mechanism and operation of the copying machine of this type are commonplace in the art and therefore will not be explained in detail.

Particularly, the fundamental structure and function of the sheet transferring means 10 including characteristic elements of this invention will be described hereinafter.

Figure 4:
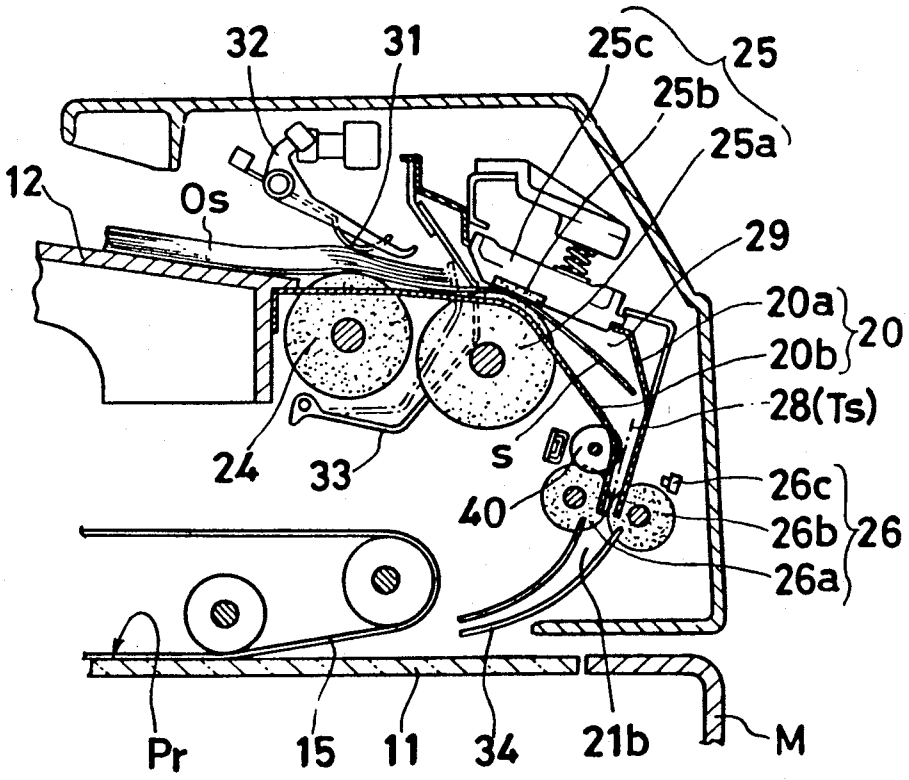
FIG. 4 is a schematical side view in section showing the principal portion of the sheet feeding device of this invention.
Figure 1A:
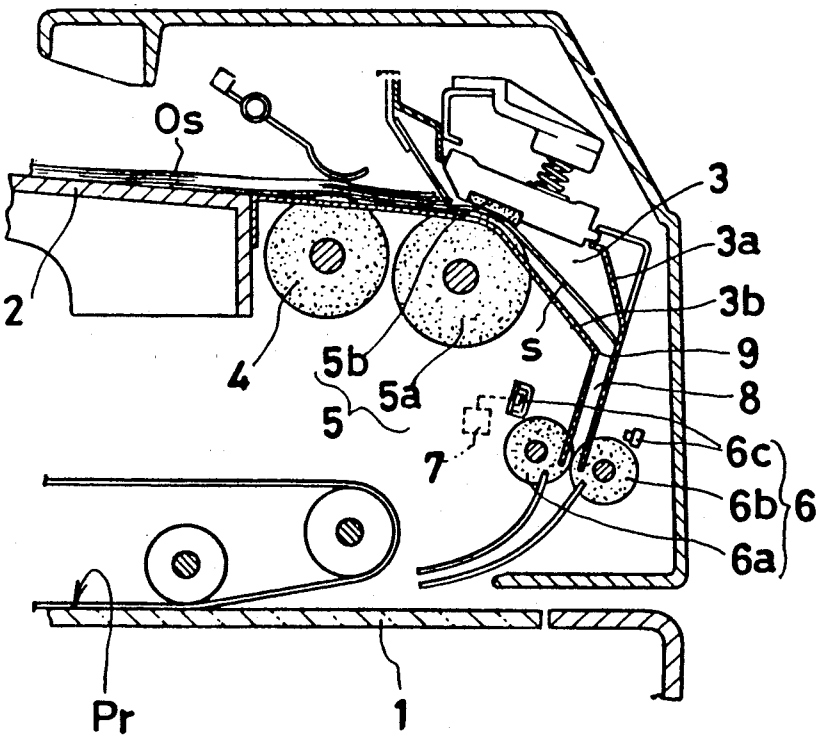
FIG. 1(A) PRIOR ART
FIGS. 1(A) and 1(B) are a sectional side view showing the principal portion of a conventional sheet feeding device and an explanatory diagram showing the state in which a tension force is exerted into a sheet to be fed along a sheet guide passage.

The sheet transferring means 10 is arranged along the sheet guide passage 20 formed in a substantially U shape as illustrated in FIG. 4. Along the passage 20 there are disposed at least one pickup roller 24 for drawing out one original sheet s from the stacked sheets Os on the tray 12, a sheet separation means 25 for permitting only one sheet from the stacked sheets Os to pass therethrough, and a skew correction means 26 for correcting the sheet obliquely advancing along the sheet guide passage 20. The sheet separation means 25 consists of at least one set of sheet separation roller **25*a* and friction pad 25*b***.

The aforenoted pickup roller 24 has a circumferential surface being large in frictional coefficient and is located about the sheet inlet **21*a* of the sheet guide passage 20. When starting the sheet feeding operation, the pickup roller 24 and sheet separation roller 25*a* are rotated at the same peripheral velocity in a sheet feeding direction, whereas only the pickup roller 24** can be reversed.

The skew correction means 26 is located about the sheet outlet **21*b* of the sheet guide passage 20 and consists of at least one set of pair of skew correction rollers 26*a*, 26*b* which are in contact with each other and sheet sensor means 26c. At least one of skew correction rollers 26a, 26b may be driven as a driving roller. In this case, the other roller is brought in frictional contact with the driving roller. Though the sheet sensor means 26c** in this embodiment is of a photocoupler composed of a photosensor and a light emitting element, the structure thereof is not specifically limited.

The sheet guide passage 20 extending from the pickup roller 24 to the skew correction rollers 26a, 26b is defined by an outer guide plate 20a and an inner guide plate 20b and reduced in width towards the skew correction rollers 26a, 26b so as to secure detection sensitivity of the sensor means 26c.

In the vicinity of the pickup roller 24 there are disposed a sheet pressure means 31, an empty sensor 32, and a gate stopper 33. These elements are operated in conjunction with one another under the control of a control system of the copying machine.

The sheet pressure means 31 is disposed opposing to the pickup roller 24 so as to press down the sheets Os stacked on the tray 12 against the pickup roller 24 with a moderate force. Thus, by rotating the pickup roller 24, the lowermost sheet of the stacked sheets Os, which is in frictional contact with the pickup roller 24, can be sent out forwardly without fail.

The empty sensor 32 serves to detect whether the sheet exists on the tray 12. In the absence of the sheet on the tray 12, the device is not operated even when being given operating instructions.

The gate stopper 33 is disposed movably upward and downward between the pickup roller 24 and the sheet separation roller 25a so as to prevent the sheet from advancing on non-feed.

The friction pad 25b is urged towards the sheet separation roller 25a by an energizing means 25c such as a spring so as to come into elastic contact with the roller 25a. The sheet separation means 25 constituted by the sheet separation roller 25a and the friction pad 25b has a function of permitting only one sheet to pass through between the roller 25a and pad 25b. To be more specific, when the sheet s is drawn out from the stacked sheets Os on the tray 12 by rotation of the pickup roller 24, the sheet separation roller 25a which rotates in conjunction with the pickup roller 24 induces the advancing of the sheet s, whereas the friction pad 25b is in frictional contact with the sheet s so that a superfluous sheet other than the lowermost sheet s being in direct contact with the roller 25a is obstructed. Further, immediately after the sheet s advancing along the passage 20 reaches the sensor means 26c, the sensor means 26c sets a timer (not illustrated) so as to bring both the pickup roller 24 and sheet separation roller 25a to a stop after the sheet s is introduced into between the skew correction rollers 26a, 26b. Thereafter, the pickup roller 24 reverses to pull back the superfluous sheet to the tray 12. Thus, what is generally passed as a double-feed phenomenon in which one or more superfluous sheets are fed accidentally together with the sheet to be copied can be prevented completely.

The skew correction rollers 26a, 26b set to rotate immediately after the sheet s which is being sent forwarded along the sheet guide passage 20 by the rotating pickup roller 24 and sheet separation roller 25a comes into touch with the rollers 26a, 26b, thereby to correct the sheet obliquely advancing along the passage 20 by causing the sheet s to collide slightly with the rollers 26a, 26b and slacken in the passage 20.

Now, in the sheet feeding device according to this invention, at least one idle roller 40 is disposed in the sheet guide passage 20 in such a state that at least one part of the circumferential surface thereof protrudes into the passage 20.

As a result, between the idle roller 40 and the skew correction rollers 26a, 26b is formed a substantially straight path 28. Namely, the sheet guide passage 20 is sectioned to a sheet turning path 29 and the substantially straight path 28 by the idle roller 40. It is preferable to substantially coincide the straight path 28 with a tangent line (Ts) to the idle roller 40 which passes through the contact point of the skew correction rollers 26a, 26b. The idle roller 40 serves to smoothly transfer the sheet drawn out from the stacked sheets on the tray 12 along the passage 20 and further the possibility of making the device compact.

The sheet s sent out from the sheet separation means 25 is changed in direction in the sheet turning path 29 and advances towards the straight path 28. Therefore, in order to smoothly introduce the sheet s into the straight path 28, it is desirable to gently curve the outer guide plate 20a.

In the illustrated embodiment, there is disposed an extension passage 34 beyond the skew correction rollers 26a, 26b so as to transfer the sheet s to be copied to the original reading position Pr defined on the platen 11 through the skew correction rollers 26a, 26b. This extension passage 34 can however be omitted by adopting a structure capable of interconnecting or approaching the sheet outlet 21b of the sheet guide passage 20 to the original reading position Pr.

Figure 5:
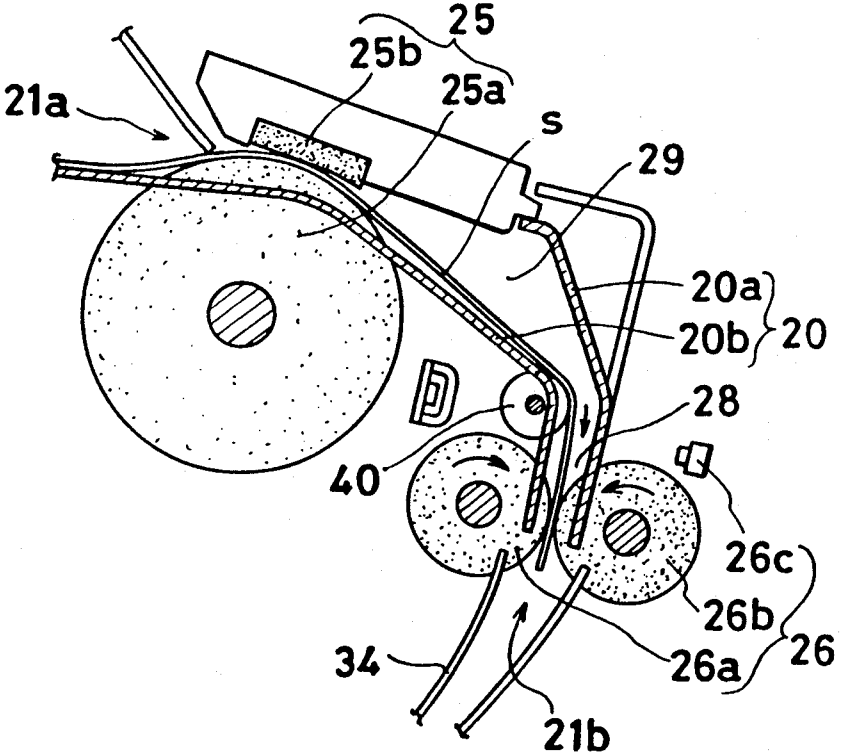
FIG. 5 schematically shows the manner in which the sheet feeding device according to this invention functions to advance the sheet smoothly.
Figure 1:
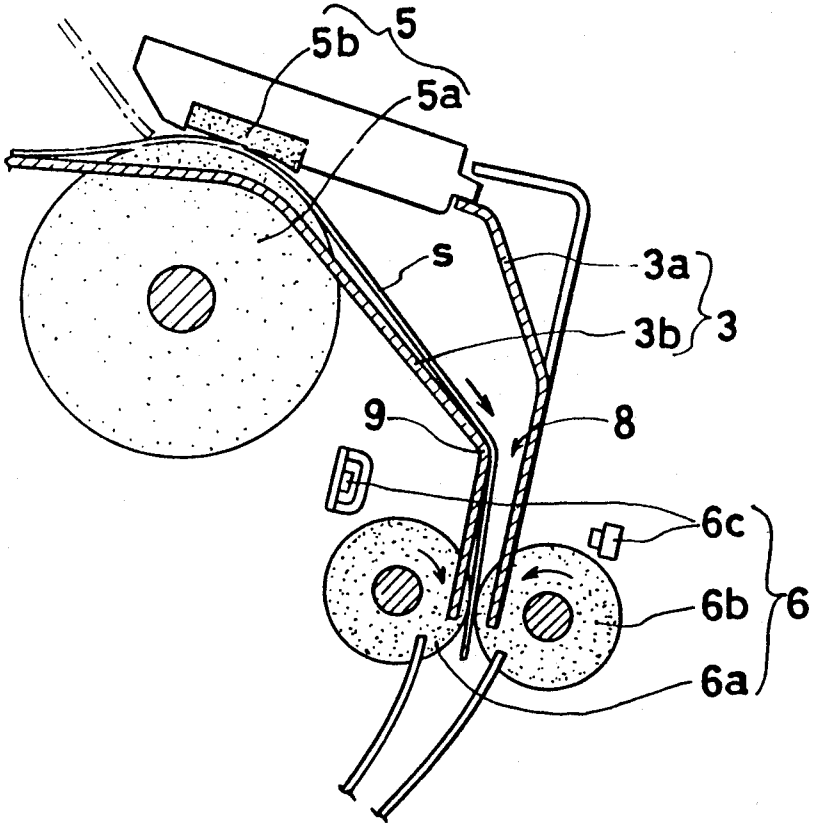
FIG. 1 (B) PRIOR ART

It will be understood from the foregoing that the provision of the idle roller 40 in the non-linear sheet guide passage 20 gives rise to the substantially straight path 28 along the tangent line (Ts) to the idle roller 40 which passes through the contact point of the skew correction rollers 26a, 26b, thereby to effectively perform the skew correction for the sheet obliquely advancing along the passage 20 and smoothly advance the sheet s in an appropriate condition of transferring. Besides, even if the sheet s advancing the passage 20 is drawn at the leading end portion thereof into between the rotating skew correction rollers 26a, 26b in such a state that the rear end portion thereof is still retained by the sheet separation roller 25a at a stop to thereby exert a tension force to the sheet s, the sheet can advance along the sheet guide passage 20 without coming into contact with the inner guide plate 20b as shown in FIG. 5. Therefore, the sheet s is no longer scratched and does not produce harsh noises in advancing along the sheet guide passage 20. Besides, no matter how large the curvature of the passage 20 is, i.e. if the passage 20 is sharply curved or bent, the transferring resistance brought about when the sheet is fed along the passage 20 is not increased by virtue of the idle roller 40. Because of this, the device can be made compact.

Figure 6:
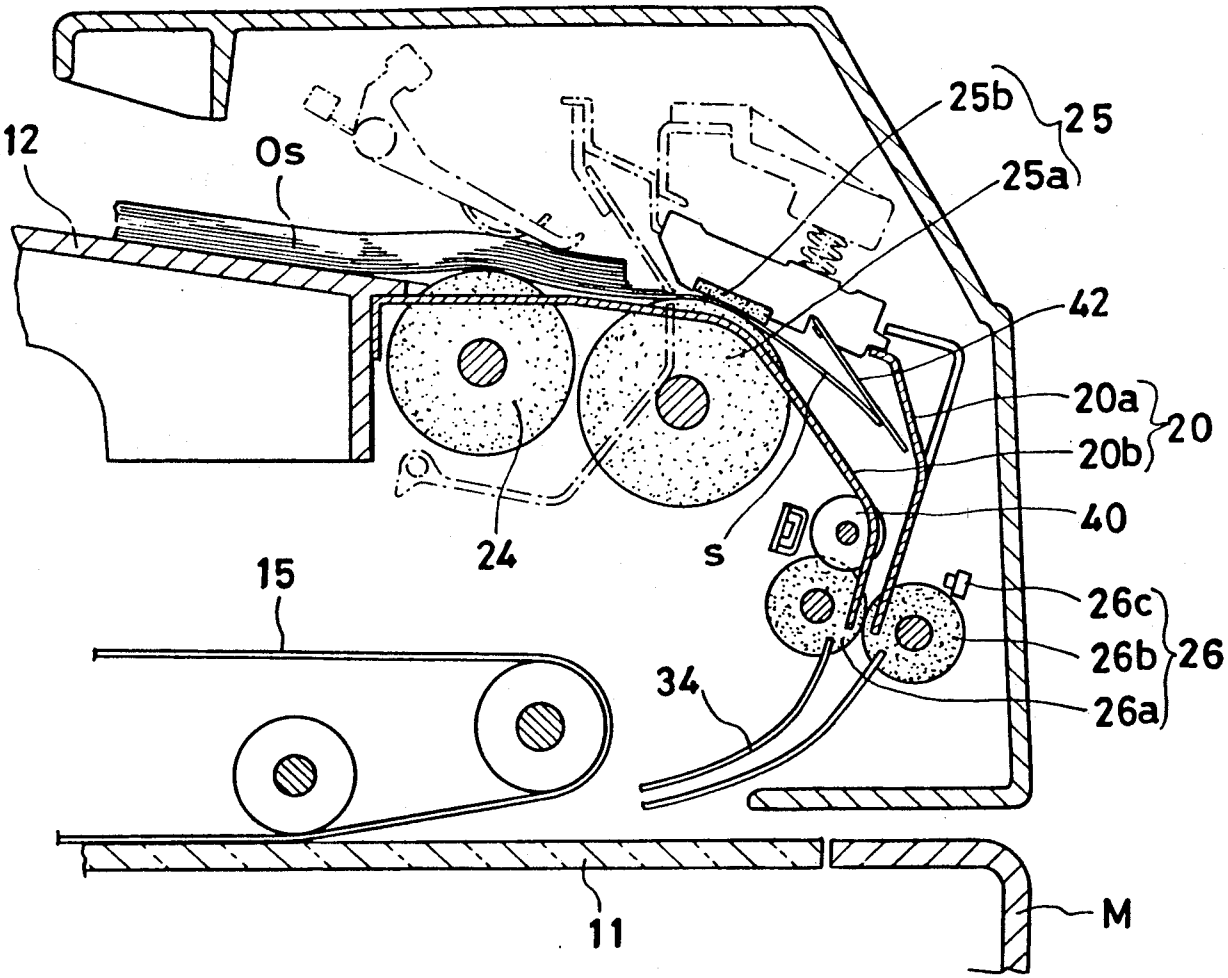
FIG. 6 is a schematically side view in section of another embodiment of this invention.

In another embodiment illustrated in FIG. 6, within the sheet turning path 29 of the sheet guide passage 20 there is provided at least one elastic damping member 42 along the outer guide plate 20a. The damping member 42 serves to receive elastically the leading end of the sheet s which is introduced into the sheet turning path 29 by the rotating sheet separation roller 25a. Similarly, the springy force brought about by the rear end portion of the sheet being released from the sheet separation means 25 is effectively depressed owing to the damping member 42. Thus, the sheet s can considerably smoothly advance along the passage 20 without producing unpleasant harsh noises.

In this embodiment, the damping member 42 made of an elastic sheet having at least one smooth surface is fixed to a pad holder 25*c* for supporting the friction pad 25*b* of the sheet separation means 25. In the illustrated embodiment, the damping member 42 is attached at its upper end to the pad holder 25*c*, whereas it may instead be fixed at the lower end or both upper and lower ends thereof onto any other portions than the pad holder 25*c*. The damping member 42 may not necessarily be of a sheet material.

By virtue of the elastic damping member 42 disposed in the sheet turning path 29 of the passage 20, even if the sheet s is fed through the passage 20 at a high rate of speed, the leading end of the sheet being introduced into the path 29 or the rear end of the sheet being released from the sheet separation means 25 is elastically received so that impact noises produced in introducing the sheet into the sheet turning path 29 or releasing the sheet rear end portion from the sheet separation means 25 can be considerably suppressed. Besides, the sheet can be smoothly fed along the passage 20 towards the skew correction rollers 26*a*, 26*b* without producing unpleasant rustling noises. In FIG. 6, the elements indicated by like reference numerals with respect to those of the first embodiment have analogous structures and functions to those of the first embodiment and will not be described in detail again.

Still, though the illustrated embodiment in FIG. 6 employs not only the damping member 42 but also the idle roller 40, the idle roller may not be used.

EFFECT OF THE INVENTION

As is clear from the description given above, since the automatic sheet feeding device according to the present invention is provided within the sheet guide passage with at least one idle roller partly protruding into the sheet guide passage, the sheets stacked on the sheet stacking tray can be transferred one by one smoothly, gently and reliably without a scratch and producing harsh noises. According to this structure, even if the sheet guide passage is sharply curved or bent, the transferring resistance brought about in advancing the sheet along the sheet guide passage can be reduced effectively owing to the idle roller disposed in the sheet guide passage, and therefore the device can be made compact with high efficiency.

Furthermore, the formation of the substantially straight path along a tangent line to the idle roller which passes through the contact point of the paired skew correction rollers enables the skew correction effect performed by the skew correction means to be heightened sufficiently. Accordingly, even the sheet obliquely advances along the sheet guide passage can completely be corrected to a suitable posture parallel to the sheet feeding direction.

Additionally, by providing the elastic damping member in the sheet turning path of the sheet guide passage, the sheet can be smoothly fed along the passage without colliding against the outer guide plate defining the passage. Therefore, the sheet can be transferred at a high speed without coming to a standstill in the sheet guide passage and producing harsh noises. In this connection, it has been actually proved that the noises produced in advancing the sheet along the sheet guide passage can be reduced remarkably.

Thus, the present invention can provide a very useful sheet feeding device applicable to various sorts of image processing devices including copying machines, facsimiles and image scanners.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. An automatic sheet feeding device comprising:

a sheet tray for stacking one or more sheets thereon;

a substantially U shaped sheet guide passage defined between an outer guide plate and an inner guide plate, and having a sheet inlet and a sheet outlet;

at least one pickup roller for drawing out one sheet from the one or more sheets stacked on the sheet tray, the at least one pickup roller being placed about the sheet inlet;

a sheet separation means disposed at the sheet inlet for permitting only one sheet to pass therethrough;

a sheet skew correction means including one pair of skew correction rollers for correcting a sheet obliquely advancing along the sheet guide passage and for transporting the sheet through the sheet outlet, the one pair of skew correction rollers starting to rotate immediately after the sheet fed through the sheet guide passage contacts the one pair of skew correction rollers so that the sheet collides with a contact point of the one pair of skew correction rollers and slackens in the sheet guide passage; and at least one idle roller disposed between the sheet separation means and the sheet skew correction means, the idle roller party protruding into the sheet guide passage to form a substantially straight path between the idle roller and the sheet skew correction means and a sheet turning path between the sheet separation means and the at least one idle roller, the straight path being inclined relative to the sheet turning path and extending substantially along a tangent line to an outer peripheral surface of the at least one idle roller, the tangent line passing through the contact point of the skew correction rollers.

2. The automatic sheet feeding device according to claim 1 wherein said sheet separation means comprises at least one set of sheet separation roller and friction pad which is urged towards said sheet separation roller.

3. The automatic sheet feeding device according to claim 1 further comprising a sheet pressure means for pressing down the sheets stacked on said tray against said pickup roller, an empty sensor for detecting the sheet on said tray, and a gate stopper for obstructing passage of said sheet on non-feed.

4. The automatic sheet feeding device according to claim 1 further comprising at least one elastic damping member disposed along said outer guide plate in said sheet guide passage.

5. The automatic sheet feeding device according to claim 4 wherein said sheet separation means comprises at least one set of sheet separation roller, friction pad urged towards said sheet separation roller, and pad holder for supporting said friction pad.

6. The automatic sheet feeding device according to claim 5 wherein said elastic damping member is retained by said pad holder.

* * * * *